US007380531B2

(12) United States Patent
Haefner et al.

(10) Patent No.: US 7,380,531 B2
(45) Date of Patent: Jun. 3, 2008

(54) VARIABLE VALVE DRIVE FOR CHANGING THE CONTROL TIMING OF CAM-ACTUATED GAS-EXCHANGE VALVES

(75) Inventors: Donald Haefner, Troy, MI (US); Florin Bugescu, Canton, MI (US)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/394,932

(22) Filed: Mar. 31, 2006

(65) Prior Publication Data

US 2006/0219198 A1 Oct. 5, 2006

Related U.S. Application Data

(60) Provisional application No. 60/667,409, filed on Apr. 1, 2005.

(51) Int. Cl.
*F01L 1/14* (2006.01)

(52) U.S. Cl. ..... 123/90.48; 123/90.52; 123/90.55; 29/888.03; 29/888.43

(58) Field of Classification Search ..... 123/90.48
See application file for complete search history.

(56) References Cited

U.S. PATENT DOCUMENTS 3,135,254 A 6/1964 Hulten
4,488,452 A * 12/1984 Jensen ..... 74/569
5,832,889 A * 11/1998 Naruoka et al. ..... 123/90.18
6,155,216 A * 12/2000 Riley ..... 123/90.15

FOREIGN PATENT DOCUMENTS

| | | |
|---|---|---|
| DE | 875105 | 7/1949 |
| DE | 3643071 | 6/1988 |
| DE | 3943426 | 4/1991 |
| DE | 4330913 | 3/1995 |
| DE | 19581378 | 12/1996 |
| DE | 10041466 | 3/2002 |
| DE | 102005010182 | 9/2006 |
| EP | 0065353 | 8/1985 |
| GB | 955988 | 4/1964 |

* cited by examiner

*Primary Examiner*—Thomas Denion
*Assistant Examiner*—Kyle M. Riddle
(74) *Attorney, Agent, or Firm*—Volpe and Koenig P.C.

(57) ABSTRACT

A variable valve drive for changing control timing of cam-actuated gas-exchange valves of an internal combustion engine is provided, with a tappet (6*a*, 6*b*, 6*c*), which, with convex cam engaging contour (5), engages a cam (4*a*, 4*b*, 4*c*) of a camshaft (3*a*, 3*b*, 3*c*) and which is guided so that it can move in the longitudinal direction in a rotatable tappet guide (7*a*, 7*b*, 7*c*), whose rotational angle (9) is adjustable for changing the control timing. In this way, the tappet guide (7*a*, 7*b*, 7*c*) can rotate about a rotational axis (8) parallel to a longitudinal axis (2) of the camshaft (3*a*, 3*b*, 3*c*).

19 Claims, 4 Drawing Sheets

VARIABLE VALVE DRIVE FOR CHANGING THE CONTROL TIMING OF CAM-ACTUATED GAS-EXCHANGE VALVES

FIELD OF THE INVENTION

The invention relates to a variable valve drive for changing control timing of one or more cam-actuated gas-exchange valves of an internal combustion engine. The valve drive has a tappet, which, with a convex cam engaging contour, engages a cam of a camshaft and which is guided in a rotatable tappet guide so that it can move in the longitudinal direction, wherein the rotational angle of this tappet guide can be adjusted for changing the control timing.

BACKGROUND OF THE INVENTION

A valve drive of this type is known from the U.S. Pat. No. 6,155,216, which is considered to be class forming. In this document, the control timing are not changed as usual through angular adjustment of the camshaft relative to the crankshaft by means of a camshaft adjuster, but instead through changes to the contact point angle of camshaft engaging contour of a tappet relative to a cam of the camshaft.

For this purpose, the cited document proposes a tappet guide that can rotate in the internal combustion engine and that can have its rotational angle adjusted within an eccentric opening to allow the tappet to move supported in the longitudinal direction. When the tappet guide rotates about its longitudinal axis, the tappet moves on a circular track, whose radius—viewed in a projection in the tappet longitudinal direction—corresponds to the eccentricity of the opening. Because the cam engaging contours of the tappet also have a radius, the track profile of the contact point between the cam and cam engaging contours simultaneously describe a circular arc—viewed in a projection in the longitudinal axis of the camshaft. Because the track profile represents the sum of the possible contact points between the tappet and cam, the angle enclosed by the circular arc corresponds to a camshaft-related change to the control timing of the gas-exchange valve actuated by this tappet.

Consequently, this principle can be used very advantageously for a cam-selective change of the control timing of gas-exchange valves. This relates especially to internal combustion engines with only a single camshaft, on which the cams are arranged together for actuating inlet valves and outlet valves. This is because, in the cases, in which the control timing of only inlet valves or only outlet valves or inlet valves and outlet valves are to be changed independently from each other, just the use of a conventional camshaft adjuster can not support this objective.

Nevertheless, the geometrical conversion of this principle proposed in the cited document has a few serious disadvantages. First, the eccentricity of the tappet in the tappet guide increases with the maximum change of the control timing to be achieved, so that the track profile of the contact point also extending in the longitudinal direction of the camshaft leads to a considerable increase in the necessary cam width. However, the cam width is restricted to tight limits in modern and compact valve drives and especially in multi-valve per cylinder internal combustion engines, so that the proposed methods can utilize only a small portion of the geometrically possible potential for changing the control timing due to the limited eccentricity of the tappet guide. Second, the tappet frequently has a cam roller as low-friction cam engaging contours to the cam. For this reason, the tappet is to be protected from twisting about its longitudinal axis and requires a highly complex torsion lock construction due to the track curve described by it. This torsion lock follows the track curve while limiting the rotational degree of freedom of the tappet. As an example for the effort to be expended in the conversion of a torsion lock suitable for this purpose, is noted in US 2004/0065282 A1.

SUMMARY

Therefore, the objective of the invention is to create a variable valve drive of the type named above, which enables the greatest possible changes to the control timing and in which the disadvantages named above are eliminated.

According to the invention, this objective is met in that the tappet guide can rotate about a rotational axis parallel to a longitudinal axis of the camshaft. Through this easily converted measure, it is possible to leave the cam width narrow and unchanged for such a valve drive with simultaneously large maximum changes to the control timing. In addition, a possibly necessary torsion lock of the tappet can be built on proven concepts, because tappet movement in the longitudinal direction no longer occurs in the longitudinal direction of the camshaft.

Protection of the tappet against torsion about its longitudinal axis is absolutely necessary in the case when the tappet is embodied for reducing the friction of the valve drive as an outer cylindrical roller tappet with a rotatable and selectively cylinder-supported roller as convex engaging contours. In this way, the roller tappet can be used for actuating a tappet push-rod, which is held in an articulated way by a dome-shaped formation of the roller tappet located on an end section away from the cam. Such tappet push-rod valve drives are used with special preference in multi-cylinder and large-volume V-motors with a single camshaft mounted in the crankcase. However, roller tappets, which actuate, for example, a rocker arm directly without an intermediate tappet push-rod, should be included within the protective scope of the invention.

At least one outer flattened section formed on the end section of the roller tappet away from the cam should be used to prevent torsional movement of the roller tappet of a tappet push-rod valve drive, wherein this flattened section extends in a transverse plane perpendicular to the rotational axis. With the help of this measure, the roller tappet can be secured with a positive fit against torsion about its longitudinal axis, for example, such that a torsion protection component connected rigidly to the internal combustion engine encompasses the end section of the roller tappet, so that an inner flattened section formed in the torsion protection component interacts in a sliding manner with the outer flattened section. However, suitable clearance of the roller tappet is to be considered due to its rotation about the rotational axis in the design of the torsion protection component.

In a useful improvement of the invention, the tappet has a hydraulic valve backlash compensation device with a non-return valve provided either as a so-called reverse-spring valve or as a so-called free-ball valve. These constructions of hydraulic valve backlash compensation devices are known as such to the technical world and therefore do not need to be described in detail at this point. Nevertheless, their principles will be explained briefly, because they can play a decisive role in fast changing speeds of the control timing of the valve drive according to the invention. A hydraulic valve backlash compensation device basically comprises a compensating piston, which defines a work chamber that can wear and also a storage chamber used for feeding the work chamber. The work chamber and the storage chamber are connected to each other hydraulically via a non-return valve in the compensating piston. In this way, a closing body, which is typically embodied as a ball, for the non-return valve is used for pressure-tight closing of the work chamber, so that the gas-exchange valve can follow the cam stroke completely in an ideal way. For this purpose, the closing body is charged with a spring means usually provided as a helical compression spring in the direction of its closing direction, in order to prevent losses in the stroke of the gas-exchange valve, which can occur during a closing process of the closing body used first at the beginning of the cam stroke due to hydraulic medium flowing past the closing body. However, on the other hand this results in the risk that undesired uneven features in the cam contours are also converted into a stroke movement of the gas-exchange valve. Such uneven features, like those created, for example, by grinding surface errors of the cam or dynamic displacements of the camshaft, can then lead in the base circle region of the cam to an undesired opening of the gas-exchange valve with the known negative results due to the load-varying profile and combustion profile, as well as the mechanical drive mechanism loading.

Under these circumstances, the use of a reverse-spring valve or free-ball valve as a non-return valve can be helpful. For these constructions, the application of force on the closing body in the direction of its closed position is eliminated. Consequently, the closing body is displaced primarily merely due to forces of the hydraulic medium flowing around it in its closed position and is held there by hydraulic pressure forces. In this respect, for a setting-in cam stroke, it first comes to a shortening of the work chamber before the closing body has completely reached its closed position and has sealed the work chamber. The controlled stroke loss generated in this way can increase more such that the closing body is charged by a spring means against the closed position in order to reduce the resulting forces acting in the closed position and consequently in order to lengthen the period of the closing process. In this case, the non-return valve is designated as a reverse-spring valve, while the free-ball valve has no spring means.

Due to the properties described above, both reverse-spring valves and also free-ball valves can be used with excellent results for compensating effects of kinematic properties of the valve drive according to the invention on the hydraulic valve backlash compensation device of the tappet. This is related primarily to the circular arc track curve—viewed in the longitudinal axis of the camshaft—for the contact point between the cam and cam engaging contours of the tappet, whereby the installation length of the tappet changes with the distance between the cam engaging contours and compensating piston for changing the control timing. A compensation path corresponding to the changed installation length of the tappet leads in a known way to lengthening or shortening of the work chamber. While a property of hydraulic valve backlash compensation devices is to compensate for an increased installation length of the tappet by directly lengthening the work chamber, in the reverse, due to the function of the non-return valve, quick shortening of the work chamber is typically possible only to a limited extent. In this respect, limits would be set for a fast changing speed of the control timing of the valve drive provided here for preventing the undesired opening of the gas-exchange valves. These limits can be expanded particularly advantageously through the use of a free-ball valve or reverse-spring valve, because these non-return valves lead to the explained low-resistance shortening of the work chamber at the beginning of the cam stroke.

In a first useful variant of the invention, the tappet guide is provided as an inner part of a ball-and-socket joint. The ball-and-socket joint can be constructed so that it encompasses a ball section provided on an outer shell surface of the tappet guide and also the bearing rings supporting the ball section so that it can rotate. The bearing rings run in the longitudinal direction of a recess of the internal combustion engine surrounding the tappet guide on both sides of the rotational axis on small circles of the ball section and are fixed in the recess at least in their longitudinal directions.

In a second advantageous variant, it is proposed to arrange the tappet guide with a central longitudinal section in a transverse through opening of a tappet guide carrier. This can rotate about the rotational axis running parallel to the longitudinal axis of the camshaft with adjustable rotational angle. Here, the tappet guide is connected essentially without play to the tappet guide carrier in the rotational direction about the rotational axis.

This variant can be especially well suited for a modular construction with a reduced number of components, in which a group of tappet guides is held and turned in common by the tappet guide carrier. For this purpose, the tappet guide carrier with a cylindrical outer shell surface is held by a cylindrical inner shell surface of a carrier tube so that the guide carrier can rotate. Clearance of the tappet guide during its rotation about the rotational axis is guaranteed in that the carrier tube has transverse and elongated hole-like openings, in which adjacent sections of the tappet guide surrounding the central longitudinal section can rotate freely about the rotational axis.

For holding another tappet guide, in which another tappet is supported so that it can move in the longitudinal direction and which is not to rotate or not in common with the first tappet guide, the tappet guide carrier has another transverse through opening. This is embodied like an elongated hole, so that the tappet guide carrier can rotate freely about the central longitudinal section of the other tappet guide in the rotational direction about the rotational axis. Fixing the other tappet guide in the peripheral direction of the carrier tube is performed, such that it adjacent section surrounding the central longitudinal section are enclosed by other transverse openings of the carrier tube, so that the other tappet guide is connected to the carrier tube in the rotational direction about the rotational axis essentially without play.

The second variant is expandable for increasing the variability of the valve drive such that the carrier tube in the internal combustion engine can rotate about the rotational axis and has a rotational angle adjustable independent of the rotational angle of the tappet guide carrier. Through this measure, an easily constructed module is created, which comprises the tappet guide carrier, the carrier tube, and tappet guides that are adjustable independently of each other in their rotational angle.

An application of the valve drive according to the invention is especially of interest for such internal combustion engines, when the cam is used for actuating a gas-exchange valve embodied as an inlet valve and is arranged together on the camshaft with another cam used for actuating a gas-exchange valve embodied as an exhaust valve. In this case, it is then possible to change either only the control timing of the inlet valve for fixed control timing of the outlet valve or vice versa, the control timing of the outlet valve for fixed control timing of the inlet valve. In addition, there is also the possibility of changing both the control timing of the inlet valve and also those of the outlet valve independent of each other, wherein optionally a camshaft adjuster can also be a component of the valve drive.

The invention is explained in more detail using embodiments below.

BRIEF DESCRIPTION OF THE DRAWINGS

In the accompanying drawings, the valve drive according to the invention is illustrated for example variants. Shown are.

DETAILED DESCRIPTION OF THE PREFERRED EMBODIMENTS

Figure 1:
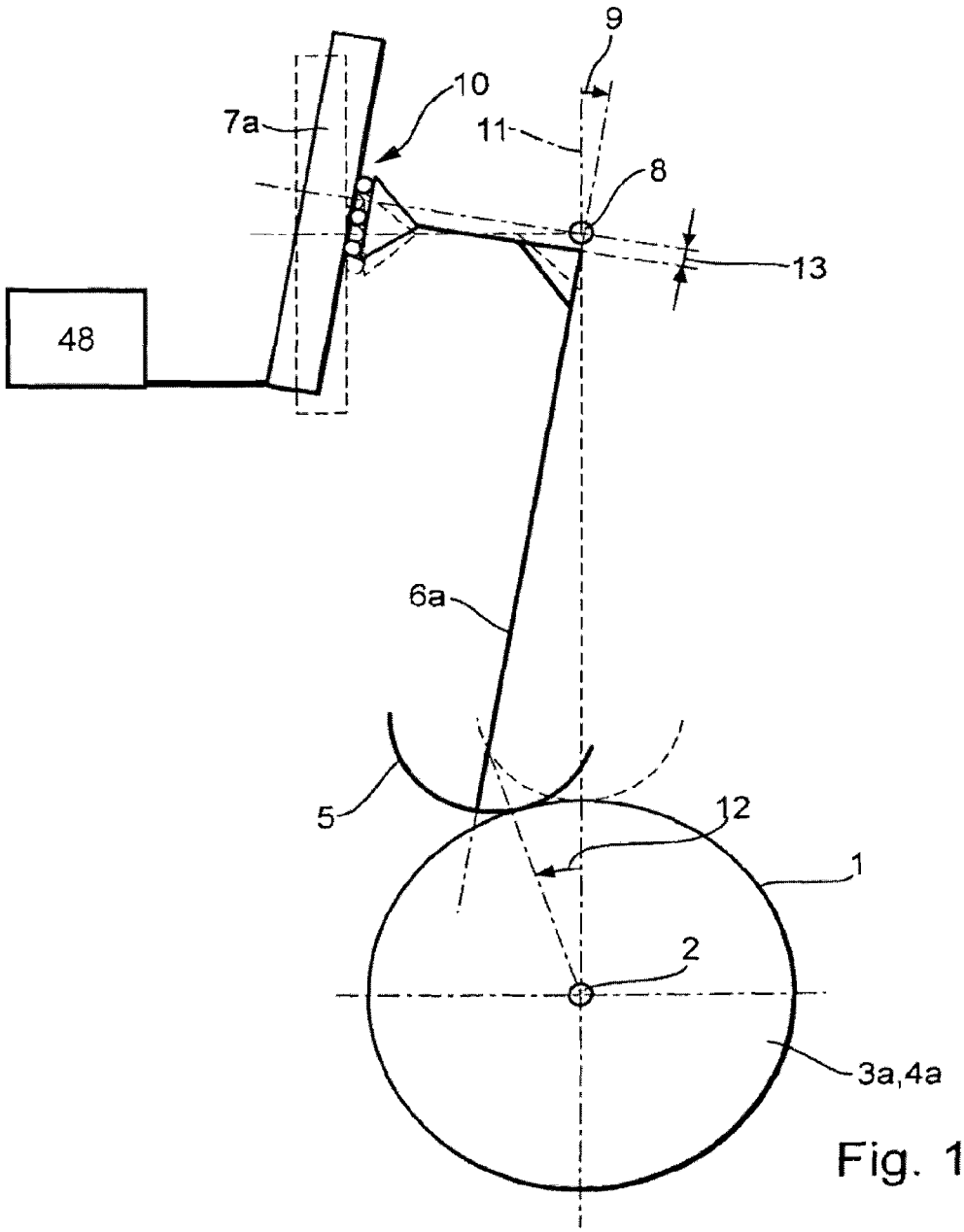
FIG. 1 a principle representation of the valve drive according to the invention, FIG. 2 a longitudinal section through a ball-and-socket tappet guide as a first variant of the invention, FIG. 3 a perspective view of a second variant of the invention with tappet guide carrier and carrier tube, FIG. 4 a sectional view taken along A-A from FIG. 3, and FIG. 5 the section B-B from FIG. 3.

The kinematic principle of the valve drive according to the invention is explained below with reference to the drive scheme shown in FIG. 1. Here, a base circle of a cam 4*a* rotating about a longitudinal axis 2 of a camshaft 3*a* in an internal combustion engine is designated with 1. The cam is engaged by convex cam engaging contour 5 of a tappet 6*a*. The tappet 6*a* can move in the longitudinal direction in a tappet guide 7*a*, which can rotate about a rotational axis 8 and whose rotational angle 9 is adjustable, so that the tappet 6*a* forms a turn-slide joint 10 with the tappet guide 7*a*.

In a base position of this embodiment shown with dashed lines, a longitudinal axis 11 of the tappet 6*a* intersects the longitudinal axis 2 of the camshaft 3*a*. Rotation of the tappet guide 7*a* about the rotational angle 9 leads to the adjusted position shown with continuous lines, in which the contact between the cam engaging contours 5 and the cam 4*a* is rotated through an adjustment angle 12. The adjustment angle 12 corresponds to a change of the control timing related to the camshaft 3*a* for the gas-exchange valves (not shown) of the internal combustion engine. It is obvious that this kinematic principle can also be applied mirror-symmetric to the longitudinal axis 11 of the tappet 6*a*, so that then a change of the control timing of the gas-exchange valves of a total of twice the adjustment angle 12 can be represented.

Furthermore, it is to be recognized that the tappet 6*a* moves through a compensation path 13 in the direction of the cam 4*a* when displaced from the base position to the adjusted position, in order to maintain contact between the cam engaging contours 5 and the cam 4*a*. The compensation path 13 is taken into account in the actual design of the tappet 6*a*, as explained in the description of the following variants of the valve drive according to the invention.

Figure 2:
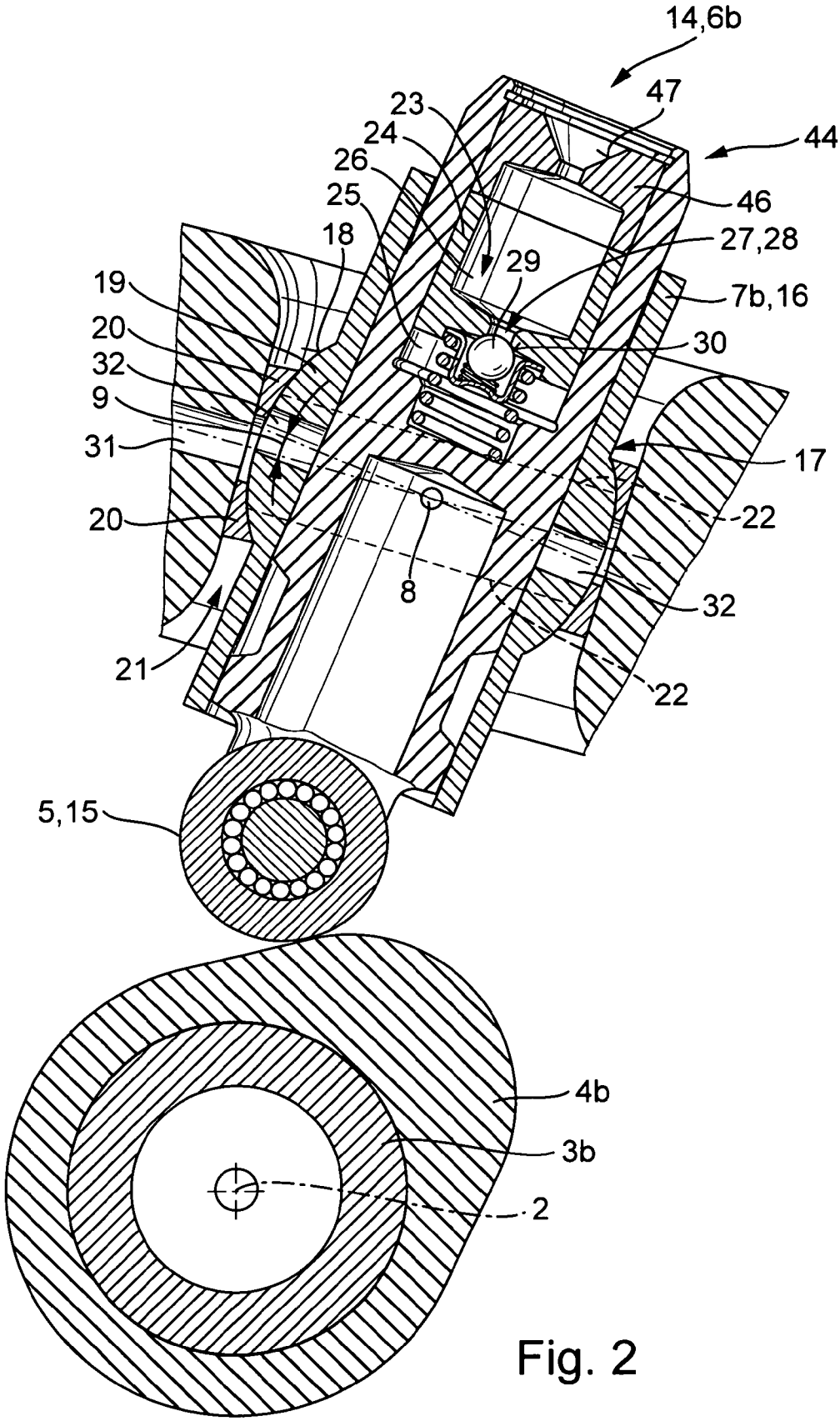

In FIG. 2, a first embodiment is shown, in which a tappet 6*b* embodied as an outer cylindrical roller tappet 14 with cam engaging contour 5 in the shape of a cylinder-supported roller 15 engages a cam 4*b*. The cam 4*b* is arranged on a camshaft 3*b* rotating about the longitudinal axis 2. The roller tappet 14 is guided so that it can move in the longitudinal direction in a tappet guide 7*b*, which is provided as an inner part 16 of a ball-and-socket joint 17 that can rotate about the rotational axis 8. The ball-and-socket joint 17 comprises a ball section 19 embodied on an outer shell surface 18 of the tappet guide 7*b* and also the bearing rings 20 supporting the ball section 19 so that it can rotate. The bearing rings 20 are arranged in the longitudinal direction of a cylindrical recess 21 surrounding the tappet guide 7*b* on both sides of the rotational axis 8 and support the ball section 19 on small circles 22. Furthermore, they are fixed in the recess 21 at least in their longitudinal directions.

The tappet guide 7*b* is shown pivoted out from the base position by the rotational angle 9. The rotational angle 9 is set by actuator 48 (see FIG. 1), which is fundamentally in active connection with the tappet guide 7*b*, so that the rotational angle 9 is set and held to a new position change. One conceivable embodiment for such an actuator is, for example, a linear actuator, which is in active connection either with one tappet guide or with a group of tappet guides 7*b* to be adjusted simultaneously. In addition to the number of actuated tappet guides 7*b*, the construction and dimensioning of the actuator are also dependent on kinematic parameters of the valve drive. Included here is, in particular, the distance of the rotational axis 8 from the longitudinal axis 2 of the camshaft 3*b*. Thus, for a given adjustment angle 12 (see FIG. 1) of the control timing, a shortening of this distance leads to an increase of the rotational angle 9. Simultaneously, the forces to be applied by the actuator can be reduced, so that especially depending on these parameters an optimum compromise can be found for the distance of the rotational axis 8 to the longitudinal axis 2 of the camshaft 3*b*.

The roller tappet 14 is equipped with a hydraulic valve backlash compensation device 23, as known as such to the technical world. The valve backlash compensation device 23 comprises a compensating piston 24, which defines, on one end, a work chamber 25 and, on the other end, a storage chamber 26 for hydraulic feeding of the work chamber 25. The work chamber 25 and the storage chamber 26 can be decoupled hydraulically from each other by a non-return valve 28 constructed as a free-ball valve 27, such that a ball 29 interacts in a hydraulically sealing way with a sealing seat 30 of the compensating piston 24. A characteristic feature of the free-ball valve 27 is that the ball 29 is guided free from spring means forces merely by flow forces into the sealing seat 30 and held there. Starting from the ball 29 at a distance from the sealing seat 30, the flow forces result from hydraulic medium, which flows around the ball 29 and which leaves the work chamber 25 in the direction of the storage chamber 26, for example, at the beginning of the setting-in stroke of the cam 4*b*. Simultaneously, this produces a shortening of the work chamber 25 corresponding to a reduced installation length of the roller tappet 14. This property of the valve backlash compensation device 23 is used for the present valve drive in order to shorten the installation length of the roller tappet 14 by the compensation path 13 shown in FIG. 1, by which the work chamber 25 in the adjusted position can be lengthened relative to the base position, without the risk of undesired opening of the associated gas-exchange valve and consequently can be realized with little force and quickly.

A pressure medium channel 31, which runs in the internal combustion engine and which opens between the bearing rings 20 into the recess 21, is used for lubricating the ball-and-socket joint 17 in the contact between the ball section 19 of the tappet guide 7*b* and bearing rings 20. Bore holes 32 extending in the ball section 19 can also be used for lubricating the roller tappet 14 and also, via a not-shown hydraulic medium path, for feeding the hydraulic valve backlash compensation device 23.

Figure 3:
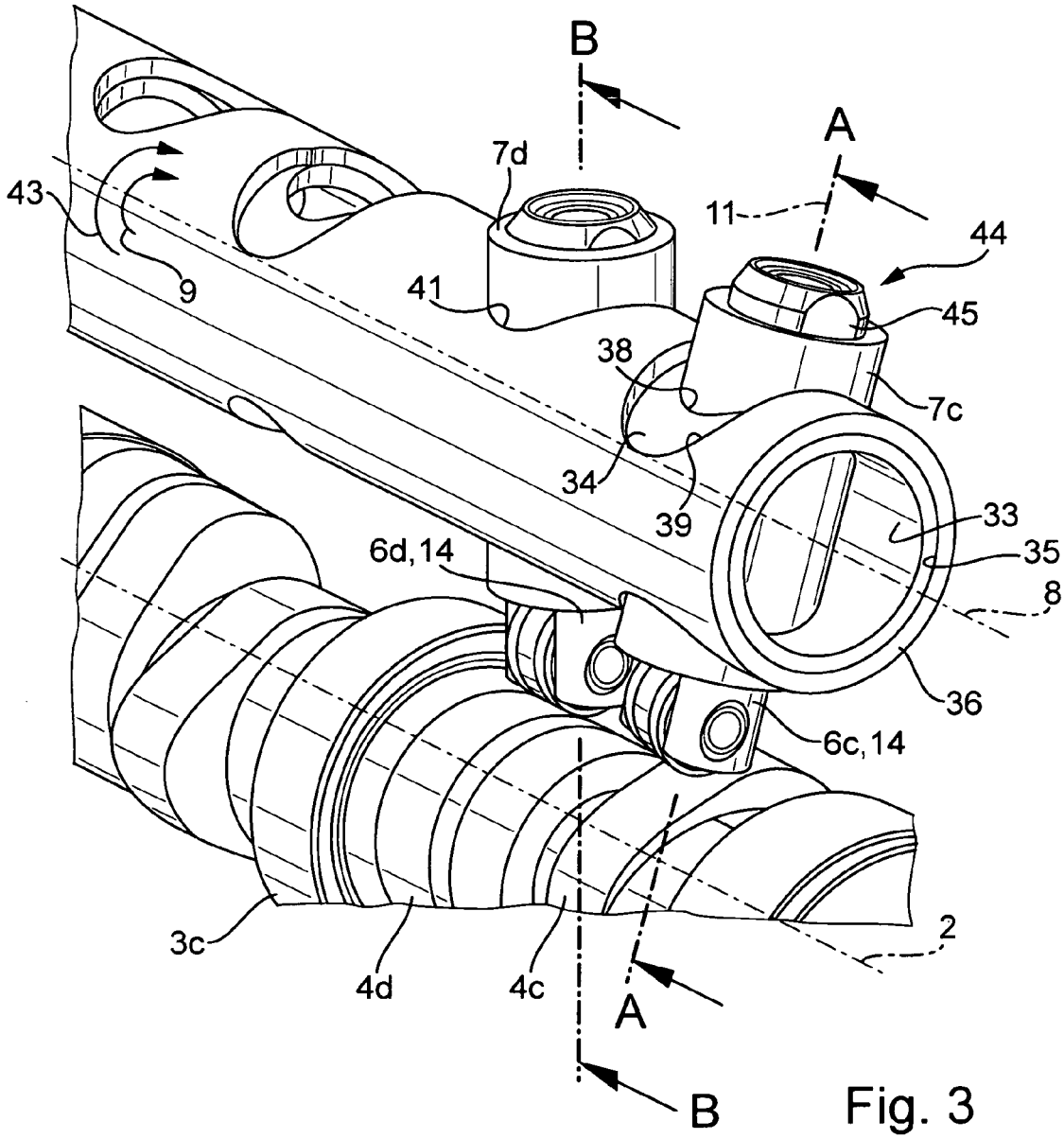

In FIG. 3, a second variant of the valve drive according to the invention is disclosed in perspective view. Shown is a camshaft 3*c* that can rotate about the longitudinal axis 2 with a cam 4*c*, which actuates a gas-exchange valve embodied as an inlet valve via a tappet 6*c* in the form of a roller tappet 14. A tappet guide 7*c* running transverse to a tappet guide carrier 33 is used for support of the roller tappet 14 moving in the longitudinal direction. The tappet guide carrier 33 has a cylindrical outer shell surface 34, with which it can rotate in a cylindrical inner shell surface 35 of a carrier tube 36 concentric to the tappet guide carrier 33 about the rotational axis 8 parallel to the longitudinal axis 2 of the camshaft 3*c* and which is adjustable in the rotational angle 9. A gas-exchange valve provided as an exhaust valve is actuated by another cam 4*d* via another tappet 6*d* also provided as a roller tappet 14. The other tappet 6*d* is supported so that it can move in the longitudinal direction in another tappet guide 7*d*, which also extends transverse to the tappet guide carrier 33.

Figure 4:
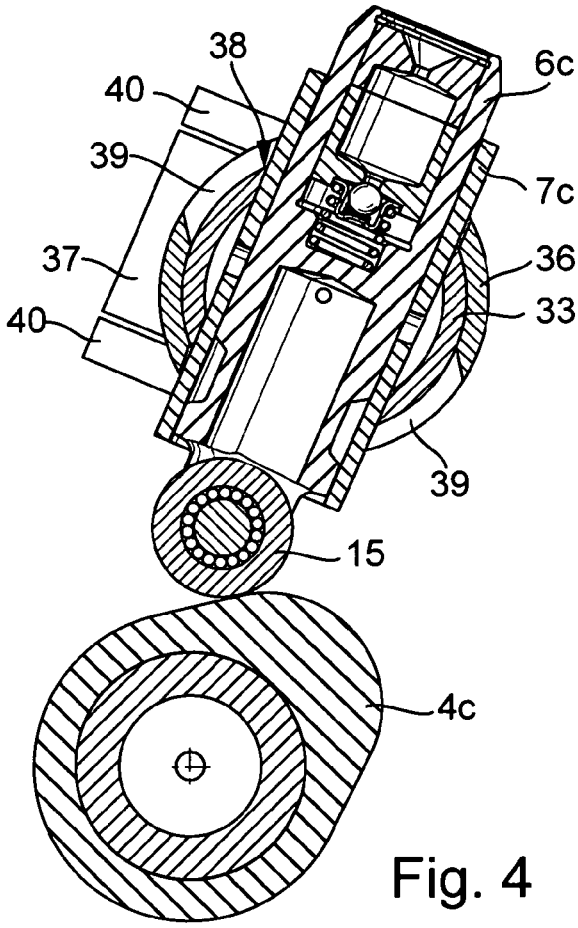

The function and design of the tappet guide carrier 33 and the carrier tube 36 are explained below with the help of FIGS. 4 and 5. FIG. 4 shows the setup of the tappet 6*c* according to the section A-A from FIG. 3. A central longitudinal section 37 of the tappet guide 7*c* is enclosed by a through opening 38 running transverse through the tubular tappet guide carrier 33, so that the tappet guide 7*c* is connected essentially without play to the tappet guide carrier 33 in the rotational direction about the rotational axis 8. The clearance of the tappet guide 7*c* in the carrier tube 36 necessary when the tappet guide carrier 33 rotates is guaranteed in that the carrier tube 36 has transverse, elongated hole-like openings 39, in which adjacent sections 40 of the tappet guide 7*c* surrounding the central longitudinal section 37 can rotate freely about the rotational axis 8.

Figure 5:
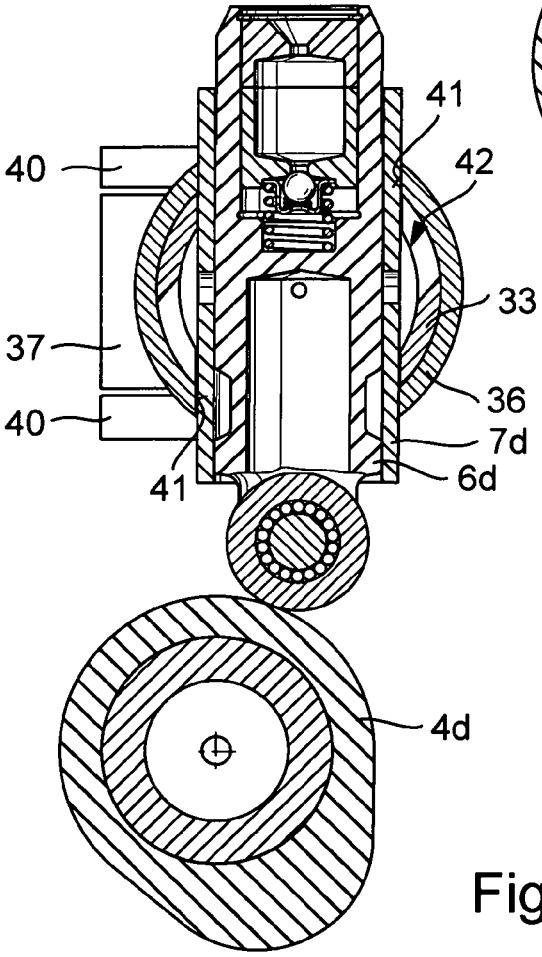

In FIG. 5, the other tappet guide 7*d* is shown according to the section B-B from FIG. 3. In this case, the other tappet guide 7*d* is connected essentially without play to the carrier tube 36 in the rotational direction about the rotational axis 8. For this purpose, other transverse openings 41 running through the carrier tube 36 are formed with circular cylinder shapes, so that the adjacent sections 40 surrounding the central longitudinal section 37 of the other tappet guide 7*d* are tightly enclosed by the openings 41. Simultaneously, the tappet guide carrier 33 about the central longitudinal section 37 of the other tappet guide 7*d* can rotate freely, in that another through opening 42 is formed transverse and elongated hole-like in the tappet guide carrier 33.

This arrangement and design of tappet guide carrier 33, carrier tube 36, and a common camshaft 3*c* for the tappets 6*c*, 6*d* permits the presentation of a compact system, which permits, in particular, a selectively adjustable changing of the control timing of inlet valves associated with the tappets 6*c* relative to exhaust valves associated with the tappets 6*d*. Changing of the control timing independently from each other both for inlet valves and also exhaust valves can be achieved in this variant such that a rotational angle 43 of the carrier tube 36 is set by another actuator independent of the actuator of the tappet guide carrier 33 and held in this position. For this variant of the valve drive, both linear actuators linked via a lever arm and also rotary drives optionally with intermediate end wheel or worm-gear drives are possible.

Each of the roller tappets 14 has at least one outer flattened section 45 running in a transverse plane perpendicular to the rotational axis 8 on an end section 44 away from the cam. Through this feature, the roller tappets 14 can be secured with a positive fit against rotation about their longitudinal axes 11, wherein this can be achieved, for example, by a fixed rotation protection component connected rigidly to the internal combustion engine each with an inner flattened section interacting in a sliding manner with the outer flattened section 45. However, in the design of the rotation protection component, the necessary clearance of the roller tappet 14 is to be considered in the rotation protection component due to its rotation about the rotational axis 8.

Finally, as is visible from FIG. 2, the roller tappet 14 has a piston top part 46 arranged in the region of the end section 44 away from the cam with a dome-shaped formation 47 for articulated holding of a tappet push-rod (not shown). Nevertheless, the valve drive according to the invention is not limited to use in such tappet push-rod valve drives, but instead can also be used in roller tappets, which actuate, for example, a rocker arm directly without intermediate tappet push-rods.

LIST OF REFERENCE SYMBOLS

1 Base circle
2 Longitudinal axis
3*a, b, c* Camshaft
4*a, b, c, d* Cam
5 Cam engaging contours
6*a, b, c, d* Tappet
7*a, b, c, d* Tappet guide
8 Rotational axis
9 Rotational angle
10 Turn-slide joint
11 Longitudinal axis
12 Adjustment angle
13 Compensation path
14 Roller tappet
15 Roller
16 Inner part
17 Ball-and-socket joint
18 Outer shell surface
19 Ball section
20 Bearing ring
21 Recess
22 Small circle
23 Valve backlash compensation device
24 Compensating piston
25 Work chamber
26 Storage chamber
27 Free-ball valve
28 Non-return valve
29 Ball
30 Sealing seat
31 Pressure medium channel
32 Bore hole
33 Tappet guide carrier
34 Outer shell surface
35 Inner shell surface
36 Carrier tube
37 Longitudinal section
38 Through opening
39 Opening
40 Adjacent section
41 Other opening
42 Other through opening
43 Rotational angle
44 End section
45 Outer flattened section
46 Piston top part
47 Formation

The invention claimed is:

1. Variable valve drive for changing control timing of one or more cam-actuated gas-exchange valves of an internal combustion engine, comprising a tappet, which, with a convex cam engaging contour, engages a cam of a camshaft and which is guided so that it can move in a longitudinal direction along a longitudinal axis in a rotatable tappet guide, having a rotational angle that is adjustable for changing the control timing, the tappet guide can rotate about a rotational axis parallel to a central axis of the camshaft.

2. Valve drive according to claim 1, wherein the tappet comprises an outer cylindrical roller tappet with a rotatable and generally cylinder-supported roller as convex cam engaging contour.

3. Valve drive according to claim 2, wherein the roller tappet has a dome-shaped formation on an end section away from the cam for articulated holding of a tappet push-rod.

4. Valve drive according to claim 3, wherein the roller tappet can be secured with a positive fit against rotation about a longitudinal axis of the roller tappet by at least one outer flattened section on an end section of the roller tappet away from the cam, wherein the flattened section extends in a transverse plane perpendicular to the rotational axis.

5. Valve drive according to claim 1, wherein the tappet has a hydraulic valve backlash compensation device with a non-return valve comprising a reverse-spring valve or free-ball valve.

6. Valve drive according to claim 1, wherein the tappet guide comprises an inner part of a ball-and-socket joint.

7. Valve drive according to claim 6, wherein the ball-and-socket joint comprises a ball section provided on an outer shell surface of the tappet guide and also bearing rings, which support the ball section so that it can rotate and which extend in the longitudinal direction of a recess surrounding the tappet guide in the internal combustion engine on both sides of the rotational axis on small circles of the ball section and are fixed in the recess at least in the longitudinal direction of the recess.

8. Valve drive according to claim 1, wherein a central longitudinal section of the tappet guide is supported in a transverse through opening of a tappet guide carrier that can rotate about the rotational axis parallel to the central axis of the camshaft through a adjustable rotational angle, so that the tappet guide is connected generally without play to the tappet guide carrier at least in a rotational direction about the rotational axis.

9. Valve drive according to claim 8, wherein the tappet guide carrier has a generally cylindrical outer surface that is held rotatably by a generally cylindrical inner surface of a carrier tube;

adjacent sections of the tappet guide surrounding the central longitudinal section can rotate freely about the rotational axis within transverse, elongated hole-like openings in the carrier tube;

the tappet guide carrier has another transverse through opening, in which another tappet guide is arranged to support another tappet so that it can move in the longitudinal direction and so that it engages another cam of the camshaft;

the other through opening of the tappet guide carrier is provided as an elongated hole so that the tappet guide carrier can rotate freely about the rotational axis by the central longitudinal section of the other tappet guide;

other openings, which extend transverse through the carrier tube and in which the adjacent sections of the other tappet guide surrounding the central longitudinal section are supported so that the other tappet guide is connected to the carrier tube generally without play at least in the rotational direction about the rotational axis.

10. Valve drive according to claim 9, wherein the carrier tube in the internal combustion engine can rotate about the rotational axis and has a rotational angle that can be adjusted independently about the rotational angle of the tappet guide carrier.

11. Valve drive according to claim 10, wherein the cam is used for actuating at least one gas-exchange valve provided as an inlet valve and is arranged together on the camshaft with another cam, which is used for actuating at least one gas-exchange valve provided as an exhaust valve.

12. Valve drive according to claim 11, wherein either the control timing of the inlet valve is variable for invariable control timing of the exhaust valve or the control timing of the exhaust valve is variable for invariable control timing of the inlet valve or both the control timing of the inlet valve and also of the exhaust valve are variable independent of each other and selectively with reference to the camshaft adjuster setting the angle of the camshaft.

13. Variable valve drive for changing control timing of one or more cam-actuated gas-exchange valves of an internal combustion engine, the variable valve drive comprising:

a tappet, which, with a convex cam engaging contour, engages a cam of a camshaft and which is guided so that it can move in a longitudinal direction in a rotatable tappet guide, having a rotational angle that is adjustable for changing the control timing, the tappet guide can rotate about a rotational axis parallel to a longitudinal axis of the camshaft, wherein the tappet comprises an outer cylindrical roller tappet with a rotatable and generally cylinder-supported roller as convex cam engaging contour, the roller tappet has a dome-shaped formation on an end section away from the cam for articulated holding of a tappet push-rod, and the roller tappet can be secured with a positive fit against rotation about a longitudinal axis of the roller tappet by at least one outer flattened section on an end section of the roller tappet away from the cam, wherein the flattened section extends in a transverse plane perpendicular to the rotational axis.

14. Variable valve drive for changing control timing of one or more cam-actuated gas-exchange valves of an internal combustion engine, the variable valve drive comprising:

a tappet, which, with convex cam engaging contour, engages a cam of a camshaft and which is guided so that it can move in a longitudinal direction in a rotatable tappet guide, having a rotational angle that is adjustable for changing the control timing, the tappet guide can rotate about a rotational axis parallel to a longitudinal axis of the camshaft, wherein the tappet guide comprises an inner part of a ball-and-socket joint, and the ball-and-socket joint comprises a ball section provided on an outer shell surface of the tappet guide and also bearing rings, which support the ball section so that it can rotate and which extend in the longitudinal direction of a recess surrounding the tappet guide in the internal combustion engine on both sides of the rotational axis on small circles of the ball section and are fixed in the recess at least in the longitudinal direction of the recess.

15. Variable valve drive for changing control timing of one or more cam-actuated gas-exchange valves of an internal combustion engine, the variable valve drive comprising:

a tappet, which, with convex cam engaging contour, engages a cam of a camshaft and which is guided so that it can move in a longitudinal direction in a rotatable tappet guide, having a rotational angle that is adjustable for changing the control timing, the tappet guide can rotate about a rotational axis parallel to a longitudinal axis of the camshaft, wherein a central longitudinal section of the tappet guide is supported in a transverse through opening of a tappet guide carrier that can rotate about the rotational axis parallel to the longitudinal axis of the camshaft through a adjustable rotational angle, so that the tappet guide is connected generally without play to the tappet guide carrier at least in a rotational direction about the rotational axis.

16. Valve drive according to claim 15, wherein the tappet guide carrier has a generally cylindrical outer surface that is held rotatably by a generally cylindrical inner surface of a carrier tube;

adjacent sections of the tappet guide surrounding the central longitudinal section can rotate freely about the rotational axis within transverse, elongated hole-like openings in the carrier tube;

the tappet guide carrier has another transverse through opening, in which another tappet guide is arranged to support another tappet so that it can move in the longitudinal direction and so that it engages another cam of the camshaft;

the other through opening of the tappet guide carrier is provided as an elongated hole so that the tappet guide carrier can rotate freely about the rotational axis by the central longitudinal section of the other tappet guide; other openings, which extend transverse through the carrier tube and in which the adjacent sections of the other tappet guide surrounding the central longitudinal section are supported so that the other tappet guide is connected to the carrier tube generally without play at least in the rotational direction about the rotational axis.

17. Valve drive according to claim 16, wherein the carrier tube in the internal combustion engine can rotate about the rotational axis and has a rotational angle that can be adjusted independently about the rotational angle of the tappet guide carrier.

18. Valve drive according to claim 17, wherein the cam is used for actuating at least one gas-exchange valve provided as an inlet valve and is arranged together on the camshaft with another cam, which is used for actuating at least one gas-exchange valve provided as an exhaust valve.

19. Valve drive according to claim 18, wherein either the control timing of the inlet valve is variable for invariable control timing of the exhaust valve or the control timing of the exhaust valve is variable for invariable control timing of the inlet valve or both the control timing of the inlet valve and also of the exhaust valve are variable independent of each other and selectively with reference to the camshaft adjuster setting the angle of the camshaft.

* * * * *